United States Patent [19]

Clark

[11] Patent Number: 4,806,046

[45] Date of Patent: Feb. 21, 1989

[54] SELF-UPRIGHTING DELINEATOR POST

[76] Inventor: Richard O. Clark, 1630 Waterson, Austin, Tex. 78701

[21] Appl. No.: 67,962

[22] Filed: Jun. 29, 1987

[51] Int. Cl.[4] ..... E01F 9/01

[52] U.S. Cl. ..... 404/10; 40/608

[58] Field of Search ..... 404/9, 10; 248/160; 40/608, 612; 52/113

[56] References Cited

U.S. PATENT DOCUMENTS

| | | | |
|---|---|---|---|
| 1,679,623 | 8/1928 | Olsen | 40/608 |
| 1,939,968 | 12/1933 | Frei, Jr. | 52/113 |
| 3,212,415 | 10/1965 | Byrd | 404/10 |
| 3,478,714 | 11/1969 | Keats | 404/10 X |
| 3,485,201 | 12/1969 | Kelley | 404/10 X |
| 3,838,661 | 10/1974 | Medley, Jr. | 40/608 X |
| 4,084,914 | 4/1978 | Humphrey et al. | 404/10 |
| 4,092,081 | 5/1978 | Schmanski | 404/10 |
| 4,106,879 | 8/1978 | Diedershagen et al. | 404/10 |
| 4,123,183 | 10/1978 | Ryan | 404/10 |
| 4,343,567 | 8/1982 | Sarver et al. | 404/10 |
| 4,565,466 | 1/1986 | Daggs et al. | 404/10 |
| 4,588,324 | 5/1986 | Goellner | 404/10 |
| 4,599,012 | 7/1986 | Kugler et al. | 404/10 |
| 4,636,109 | 1/1987 | Clausen et al. | 404/10 |

FOREIGN PATENT DOCUMENTS

| | | | |
|---|---|---|---|
| 113448 | 8/1965 | Denmark | 404/10 |
| 42810 | 12/1981 | European Pat. Off. | 404/10 |

*Primary Examiner*—Jerome W. Massie
*Assistant Examiner*—Matthew Smith
*Attorney, Agent, or Firm*—Gun, Lee & Jackson

[57] ABSTRACT

A self-uprighting delineator post construction comprises a base that may take a number of different forms and which is capable of being fixed to any suitable stationary object. A delineator post is provided which is of light weight impact resistance construction and may be composed of any one of a number of suitable impact resistant materials. A load cell is interposed between the base and delineator post and incorporates upper and lower load cell which are in abutment and pivotally disposed. The load cell elements are secured by a pair of cables disposed in side-by-side relation and maintained under tensile stress by open or a pair of compression springs which are subjected to a predetermined spring preload. The side-by-side cables fit within aligned passages of the upper and lower load cells which are of elongated cross-sectional configuration and serve to insure return of the delineator post to its properly oriented upright position after being forced toward the horizontal by an impact force.

17 Claims, 2 Drawing Sheets

FIG. 5
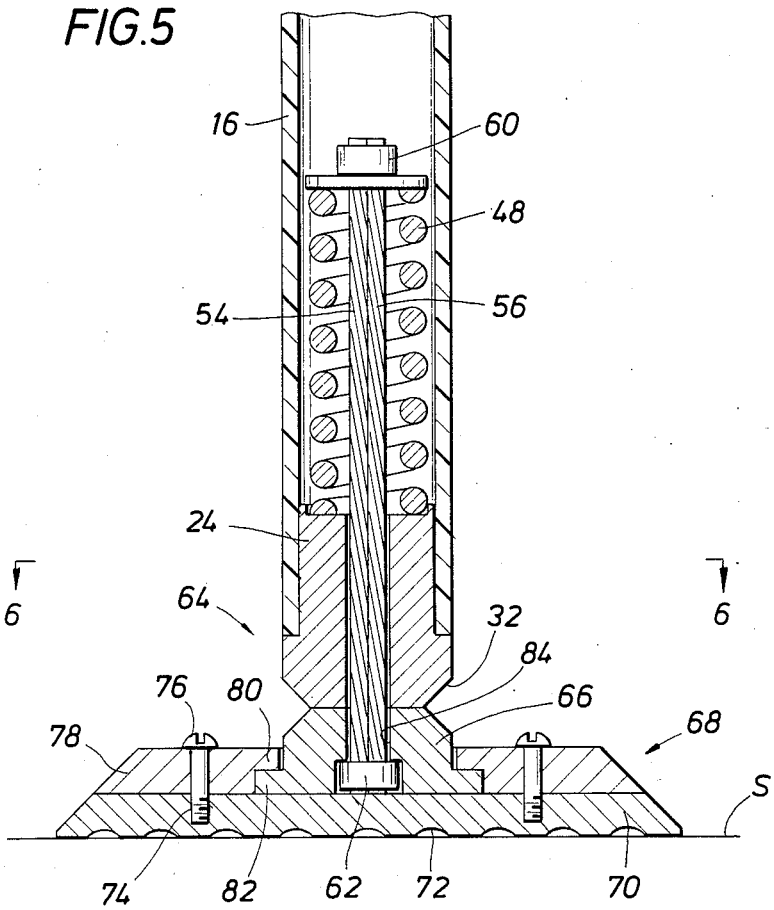
FIG. 7
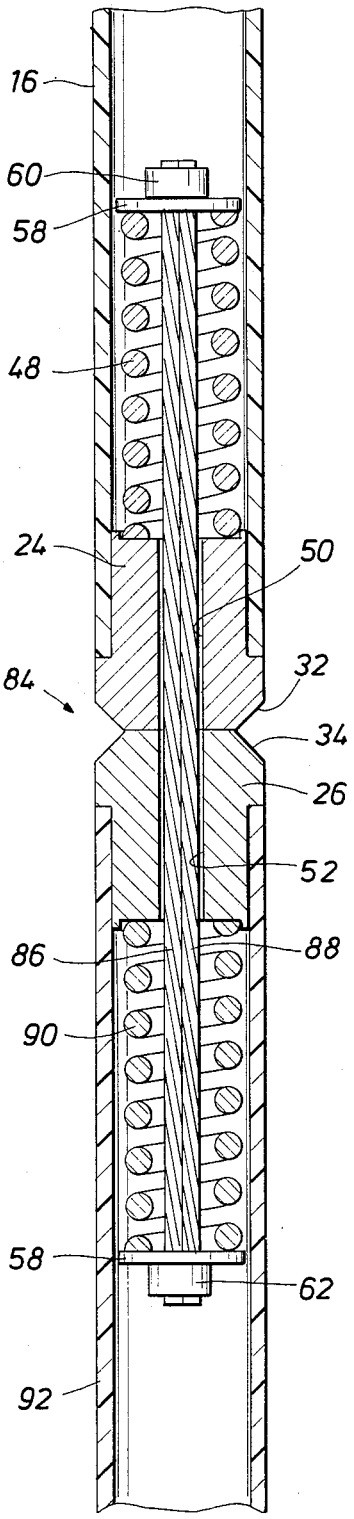
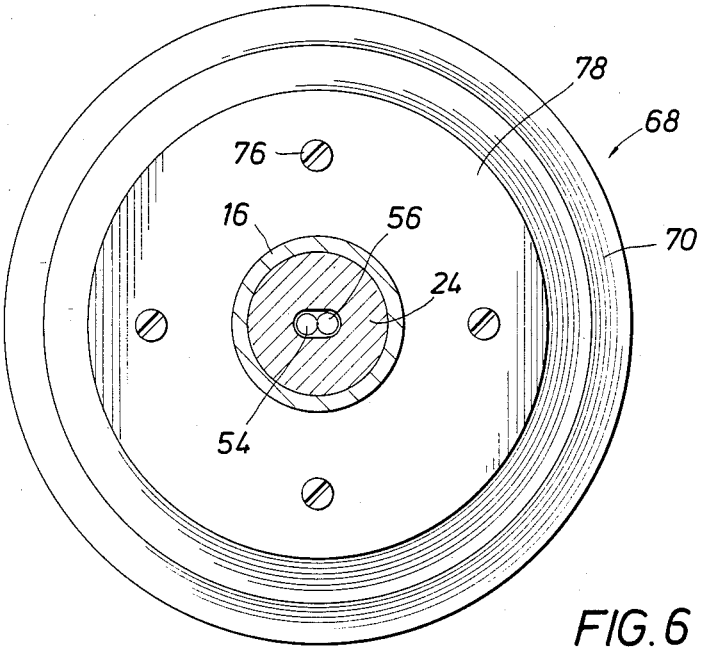
FIG. 6

SELF-UPRIGHTING DELINEATOR POST

FIELD OF THE INVENTION

This invention relates generally to delineator posts for use in delineating boundaries and hazards, such as marking the alignment of a travel way, the existence of a hazardous location, or the existence of a hazardous object. More specifically, the present invention relates to a delineator post construction which facilitates pivoting from a normally aligned, upright position to a substantially horizontal position upon being impacted by a moving object such as an automotive vehicle. Even more specifically, this invention relates to a selfuprighting delineator post constructed so as to minimize damage to the automotive vehicle and the post when such accidental striking occurs.

BACKGROUND OF THE INVENTION

Delineator posts for marking travel ways and identifying the existence of hazardous objects are typically constructed of lengths of formed metal sheet material or bar stock which are concreted or otherwise fixed to the ground or to other stationary objects. Such posts are typically provided with light reflectors to facilitate identification at night and are appropriately colored for good visibility during daylight hours. It is well known that delineator posts are frequently accidentally struck by automotive vehicles that for one reason or another leave the designated travel way. Once struck, the delineator posts are typically bent to the extent that they are thereafter unusable. Additionally, because the posts are somewhat rigid, there is a likelihood that the automotive vehicle will also be damaged by impact with a delineator post. The replacement cost of delineator posts is a major expense of travel way maintenance. It is desirable therefore to provide a delineator post construction that will not be destroyed upon impact by a moving automotive vehicle and which is likely to cause no damage to the automotive vehicle as the result of accidental collision. Consequently, it is desirable to provide a delineator post construction which will yield when impacted by an automotive vehicle and which, after passage of the automotive vehicle, will return to its upright position in a substantially undamaged condition.

Most delineator posts are permanently mounted at specific locations, such as being concreted in the ground, epoxied to stationary objects, driven into the ground, etc. In the event the position of these posts need to be changed the posts must be removed and replaced at the cost of significant material and labor. Moreover, there is no arrangement readily available for situations where delineator posts need to be periodically located for specific traffic conditions. It is desirable therefore to provide self-uprighting delineator posts that may be quickly and efficiently installed and may be removed and replaced as needed with minimal labor and material costs.

THE PRIOR ART

Generally flexible and self-uprighting delineator posts are known in the prior art. One such example is disclosed in U.S. Pat. No. 4,092,081. It is quite clear that this delineator post cannot be impacted from any direction and return to an upright position. It is not stable in windy conditions. There are numerous flexible posts which are made of resilient plastic material in several different shapes. These flexible delineator posts cannot withstand repeated impacts. Some of these structures are disclosed in U.S. Pat. Nos. 4,084,914; 4,092,081; 4,123,183 and 4,343,567. The delineator post mechanism disclosed in U.S. Pat. No. 4,106,878 contains a single spring which is tensioned upon impact. The spring cannot be easily disconnected from the base which supports the post. Tension springs do not exhibit a large amount of stiffness as compared to compression springs. Additionally, the delineator post of the patent of Diedersheen, et al. is obviously relatively expensive to manufacture. U.S. Pat. Nos. 4,636,109 and 4,588,324, relating to flexible slalom poles, and U.S. Pat. No. 4,636,108, relating to a flexible surface mount delineator, are considered to be of general interest to the subject matter of the present application.

SUMMARY OF THE INVENTION

It is a feature of the present invention to provide a self-uprighting delineator post construction that is capable of being struck many times without significant damage and without causing damage to automotive vehicles during such accidental striking.

It is also a feature of the present invention to provide a novel self-uprighting delineator post construction having a load cell incorporating one or more springs under compression which provide a significant amount of stiffness to resist forces applied thereto without being overstressed.

It is another feature of this invention to provide a novel self-uprighting delineator post construction that can be subjected to an impact force from any direction without causing damage to the mechanism thereof.

It is another feature of this invention to provide a novel delineator post construction employing a pair of spring stressed cables wherein the cables are positioned in side-by-side relation to prevent rotation and unwinding of the cables and reduction of spring force when the post is impacted.

It is an even further feature of this invention to provide a novel delineator post construction including a load cell which enables the post to be pivoted at the load cell upon being impacted and then returned to the exact position it was in before being impacted to thus insure against misorientation of reflectors and other objects that are supported by the post.

Among the several features of this invention is contemplated the provision of a novel delineator post construction that is easily and efficiently installed and may be temporarily or permanently moved from its site with minimal effort and through the use of simple, readily available tools.

It is another feature of this invention to provide a novel self-uprighting delineator post construction which incorporates differing support bases that can be easily installed by being driven into the ground, set in concrete, bolted to concrete or metal structures or epoxied to a surface and wherein the load cell and the delineator post thereof can be attached to the base at any future time and can be removed or replaced through the use of simple hand tools.

It is an even further feature of this invention to provide a novel self-uprighting delineator post construction incorporating a load cell providing significant stiffness to the post to prevent inadvertent yielding or fluttering due to windy conditions and yet provides a light weight post construction that yields readily to impacts without being damaged or causing damage to the automotive vehicle.

Briefly, the present invention is directed to a selfuprighting delineator post construction which is supported in the ground or by a stationary object and includes a lower part or base which is placed in the ground, bolted to a stationary object (bridge deck or concrete pavement) or epoxied to a stationary object (bridge deck, curb, asphaltic concrete pavement or concrete payment). The self-uprighting delineator post construction incorporates a load cell which forms a pivoting joint and an upper part which extends upwardly above the ground, curb, roadway surface or bridge deck. The upper part is adapted to pivot about the lower part by means of a pivoting joint when subjected to an impact force from any direction. The pivoting joint includes a restoring means for returning the post to its normally aligned upright position following cessation of the impact force. The load cell resists rotation relative to the base during pivoting movement and thus returns the delineator post precisely to its proper oriented position upon uprighting of the post. The delineator post is capable of being moved from its upright position to a position in excess of 90° and yet return to its original upright alignment. The delineator post incorporates a load cell construction employing one or two spring members maintained in compression by a flexible cable system that permits at lesat 90° bending of the delineator post upon impact. The cable system employs two spring tensioned cables which travel inside a slot of elongated cross-sectional configuration which extends through the upper and lower parts of the load cell along the x-axis which disallows rotation of the post about the x-axis. This feature prevents the cables from rotating and becoming unwound when impacted and thereby prevents the cables from releasing the compression on the spring that keeps the delineator post rigid and upright. An important feature of the load cell is that it incorporates a pair of interfitting beveled load cell sections which interfit both when the load cell is upright and when it is yielded 90° by an impact force. The delineator post assembly incorporates a base structure which can be secured to the ground or easily secured to various fitted objects and surfaces which are commonly found on and about roadways. The delineator post construction is easily and quickly assembled to the base or removed from the base through the use of simple tools. Also, the delineator post construction is easily removed from the base for repair or replacement through employment of minimal labor.

Other and further features of the invention will become apparent to one skilled in the art upon a review of the detailed description, claims and drawings which form this patent specification.

BRIEF DESCRIPTION OF THE DRAWINGS

In order that the manner in which the above recited advantages and features of this invention are attained and can be understood in detail, more particular description of the invention, briefly summarized above, may be had by reference to the specific embodiments thereof that are illustrated in the appended drawings, which drawings form a part of this specification.

It is to be noted, however, that the appended drawings illustrate only typical embodiments of the invention and are therefore not to be considered limiting of its scope, for the invention may admit to other equally effective embodiments.

IN THE DRAWINGS

Figure 1:
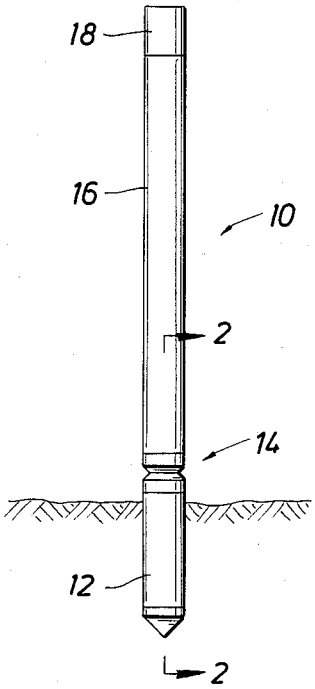

FIG. 1 is an elevational view of a self-uprighting delineator post that is constructed in accordance with the principals of the present invention.

Figure 2:
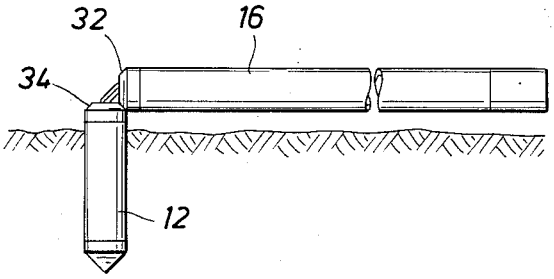

FIG. 2 is an elevational view of the delineator post of FIG. 1 illustrating the yielded position of the post after being accidentally struck and forced to its 90° horizontal position such as by an automotive vehicle.

Figure 3:
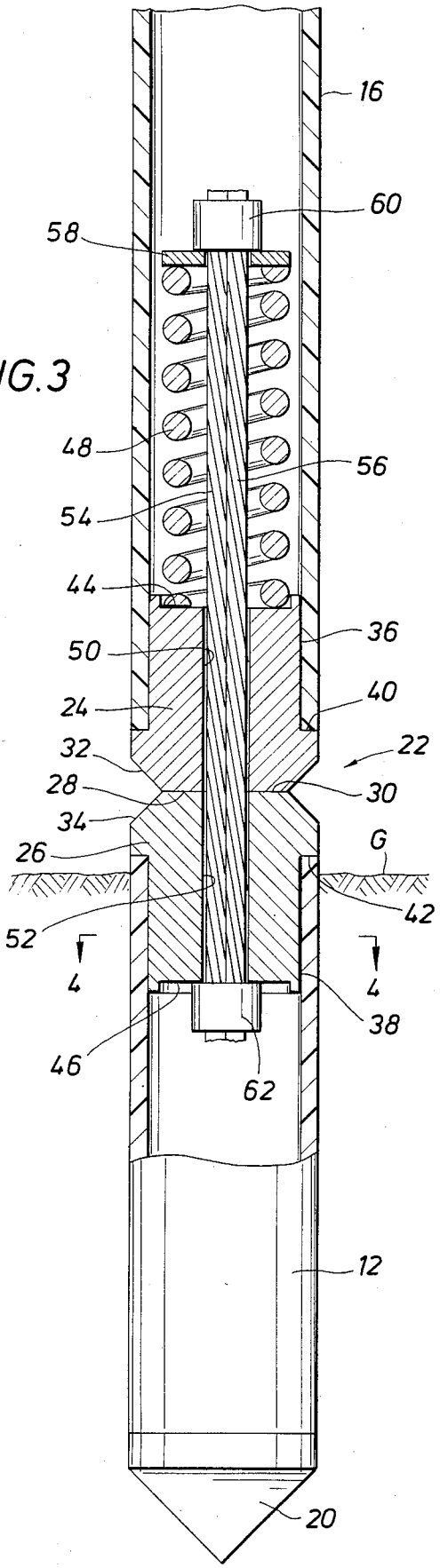

FIG. 3 is a partial sectional view of the delineator post construction, taken along line 3—3 of FIG. 1 and showing the load cell construction thereof in detail.

Figure 4:
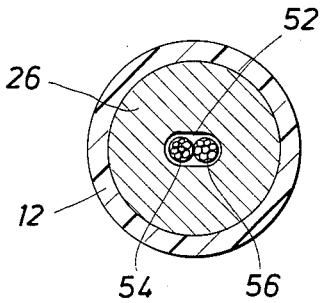

FIG. 4 is a sectional view taken along line 4—4 of FIG. 3.

FIG. 5 is a partial sectional view of a self-uprighting delineator post and base assembly representing a modified embodiment of this invention.

FIG. 6 is a view taken along line 6—6 of FIG. 5, showing the load cell in section and illustrating the base construction in plan.

FIG. 7 is a partial sectional view of a self-uprighting delineator post construction representing another alternative embodiment of this invention.

DETAILED DESCRIPTION OF PREFERRED EMBODIMENTS

Referring now to the drawings and first to FIG. 1 a self-uprighting delineator post construction is illustrated generally at 10 wich incorporates a base 12, a load cell illustrated generally at 14 and a light weight post 16. The upper end of the light weight post may be provided with a reflector 18 which may be attached with adhesive, bolted on or otherwise attached to the light weight post to provide reflection of light, thus permitting the post to be readily visible under night driving conditions. The post and the reflector may be of a suitable color enabling it to be readily visible during daylight conditions. The material composing the post 16 may comprise any one of a number of suitable light weight polymer materials that are impact resistant. Since the post is of light weight construction it does not present significant resistance to impact forces when it is accidentally struck such as by an automotive vehicle. This feature prevents damage to the post and also prevents damage to the automotive vehicle as the post is accidentally struck and shifted from the position shown in FIG. 1 to the position shown in FIG. 2.

With reference now to FIG. 3, the self-uprighting delineator post construction of this invention incorporates a mounting base structure enabling the delineator post to be secured to the ground, to a roadway or to other fixed objects. In the embodiment shown in FIG. 1, the mounting base structure 12 is in the form of a tubular base element incorporating a penetrating point 20 at its lower extremity which enables the base structure to be driven into the ground G to a suitable depth to provide for sufficient structural integrity of the delineator post construction. The tubular mounting base 12 may be composed of any one of a number of suitable polymer materials of sufficient structural integrity to withstand driving forces as it is driven into the ground. Alternatively, the tubular support base 12 may be composed of any one of a number of suitable metal materials, such as coated steel material. The penetrating point 20 may be composed of metal or any one of a number of suitable polymer materials. Another suitable base structure is shown in FIG. 5 and discussed in detail hereinbelow.

Regardless of the type of mounting base, the selfup-righting delineator post construction is provided with at least one load cell illustrated generally at 22 having substantially identical upper and lower load cell elements 24 and 26 that are normally positioned with respective generally planar abutment surfaces 28 and 30 in abutting engagement. The load cell elements 24 and 26 each define frusto-conical end surfaces 32 and 34 which are capable of coming into contact in the manner shown in FIG. 2 as the load cell is yielded in response to an impact force applied to the post element 16. The load cell elements each define reduced diameter surface portions 36 and 38 that intersect larger diameter portions of the load cell elements in a manner forming abutment shoulders 40 and 42. The tubular base element 12 and the tubular delineator post 16 are each received in close fitting relation about the cylindrical reduced diameter surface shoulders 40 and 42 in the manner shown in FIG. 3. The tubular elements may be secured to the load cell elements in any suitable fashion such as by screws, threading, etc. If desired, the fit between the tubular elements 12 and 16 and the respective load cell elements 24 and 26 may be in order of a friction fit. In the alternative, any other sort of connection means may be employed to establish a positively secured relationship between the tubular elements and the load cell elements.

As mentioned above, the load cell elements 24 and 26 may be of identical construction. As shown in FIG. 3 the load cell elements 24 and 26 define respective end recesses 44 and 46. In the embodiment of FIG. 3 recess 46 has no particular function. However, in the embodiment of FIG. 7, dual springs are utilized which are seated within the end recesses of each load cell element. The recesses 44 and 46 therefore function as spring recesses to insure centralization of single or dual compression spring members such as shown at 48 in FIG. 3.

Each of the upper and lower load cell elements 24 and 26 is formed to define a vertical central passage such as shown at 50 and 52. As is evident from FIG. 4 these vertical passages are of oval or elongated cross-sectional configuration to thus provide for proper retention of side-by-side cable members 54 and 56. Tensile stress is applied to the cable 54 and 56 by the compression spring 48. A platform washer 58 is received about the cable and is retained by means of a cable stop sleeve member 60. A lower cable stop sleeve member 62 is secured to the opposite end of the cables 54 and 56 and is maintained in engagement with the stop surface 46 by the force applied by the compression spring 48. The platform washer 58 functions as a stop member for the upper end of the compression spring.

During assembly the compression spring is initially compressed and the upper and lower cable stop sleeves 60 and 62 are swaged onto the cable ends and provide stops to maintain the cables under tension. This tension maintains the abutment surfaces 28 and 30 in contact thus maintaining the upper and lower load cell elements in properly aligned position. The abutment surfaces 28 and 30 are disposed in normal relation to the x-axis defined by the aligned passages 50 and 52. Thus when the abutment surfaces are in contact the passages 50 and thus the post 16 are vertically disposed. This feature causes the delineator post to be properly aligned with respect to the base structure 12. The two cables, thusly sprung, extend through the oval passages 50 and 52 of the upper and lower load cell elements along the x-axis. This side-by-side cable arrangement prevents rotation of the delineator post about the x-axis and thus ensures that the post 16 always returns to its original position and the reflectors of the post remain properly oriented. If the cables were extended through a circular passage, the cables would rotate and unwind when impacted, thereby releasing the compression on the spring that maintains the post rigid and upright. Through employment of dual side-by-side cables the load cell is permitted to bend efficiently in any direction at the load cell joint defined by the abutment surfaces 28 and 30 and the cables 54 and 56 are not permitted to unwind. Thus, the spring tension applied to the cables always remains constant as long as the positions of the cable stop sleeves 60 and 62 remain firmly established. Obviously the cable stop sleeves 60 and 62 may be applied to the cables by means other than swaging, but, a swaging operation is quite inexpensive and has found to be quite effective. The dual cable arrangement also provides the selfup-righting delineator post construction with capability of always righting itself in the exact position that the delineator post was in before being impacted. Thus, a reflector which is mounted on a post and oriented to face towards on-coming traffic will not be disoriented after the post is impacted.

Because of the tapered surfaces 32 and 34 the load cell of the delineator post construction is enabled to readily pivot to the position shown in FIG. 2 when the post is impacted. The post can be subjected to an impact force from any direction. Due to the pivoting displacement of the upper and lower parts of the load cell as the result of an impact force, the compression spring will become additionally loaded under compression, thereby storing energy for subsequent realignment of the upper and lower parts of the load cell. Obviously, during such realignment the delineator post is uprighted from the position shown in FIG. 2 to the position shown in FIG. 1. The delineator post can be pivoted in excess of 90° and still return to its original upright position. As the load cell is yielded more than 90° the cables 54 and 56 are simply moved further, thereby causing further compression of the spring member 48. As long as the spring member is not overstressed and the cable stops remain properly positioned the delineator post will always return to its upright properly oriented position after the impact force has diminished.

The load cell assembly 22 comprising the upper and lower load cell elements 24 and 26 with the cables 54 and 56 maintaining the spring member 48 under compression, form an integral load cell unit. This load cell unit may be employed in a number of differing delineator post constructions. After the base tube 12 has been properly installed in the ground, the load cell is assembled to the base. The load cell can be installed with the spring mounted inside the post or inside the base except for the flush mounted base installation. For the flush mounted base installation, the load cell must be installed with the spring mounted inside the post. The delineator post construction is completed by assembly of a tubular post to the upper portion of the load cell. Thus, assembly of the delineator post construction is also simple and efficient. This feature provides the delineator post construction with a temporary or permanent nature as is desired by the users. In the event a load cell or a delineator post should become weakened or damaged it can be quickly and efficiently replaced through the use of simple tools. In this regard it should be noted that the spring of the load cell is not housed until the post or base is attached to the load cell. The hollow post or base acts as a housing to protect the spring assembly and to keep the spring aligned with the x-axis of the load cell and not to bend under flexure. The housing also keeps debris from impeding the spring travel.

Referring now to FIGS. 5 and 6 a self-uprighting delineator post construction is illustrated which represents an alternative embodiment of this invention with like parts being referred to by like reference numerals. A load cell is illustrated generally at 64 which incorporates an upper load cell element 24 which may be of identical nature as that shown at 24 in FIG. 3. The load cell 64 incorporates a lower load cell element 66 which is supported by a base assembly shown generally at 68. The base assembly 68 incorporates a base plate 70 forming a lower surface 72 that is prepared in any suitable fashion to be bonded to any suitable surface S, such as a roadway surface. The base plate forms threaded openings 74 which receive screw or bolt members 76 that extend through a retainer plate 78 and secure the retainer plate to the base plate. The retainer plate forms a receptacle for the lower portion of the lower load cell 66 and forms a retention flange 80 that secures and centralizes the lower flange portion 82 of the lower load cell element and permits relative rotational positioning of load cell element 66 relative to the base 68 to permit rotational adjustment of the post 16. The lower load cell element forms a passage 84 of oval cross-sectional configuration to receive the two cable members 54 and 56 in side-by-side relation. The load cell is thus firmly secured by the base structure and may be quickly and easily assembled or removed with respect to the base structure. This provides a system of portability that allows the delineator post to be easily removed or installed as is desired. If the positions of delineator posts need to be changed from time to time only the lower base plates 70 need be firmly affixed to surfaces or stationary objects. The other components of the delineator post system may be easily and quickly applied through the use of simple tools.

The joint of the load cell is in closely spaced relation with the surface S. Therefore, as the delineator post is struck the load cell bends or pivots along the x-axis near the surface S. Thus, the delineator post is pivoted at or near ground level, thereby reducing contact of the post structure with the undercarriage of the impacting vehicle. This feature minimizes damage to the post and the vehicle. Another feature that should be noted is that the delineator post may be removed such as for replacement without necessitating removal of the load cell from the base structure. The tubular post is simply withdrawn from its seated relationship with the upper load cell element 24 thereby exposing the spring and cable for inspection. A damaged post can be replaced or a post of different character can be installed in place of a particular type of post that might not be required. The post is designed for quick and conventional replacement in the event that the post is destroyed or no longer effective. Any one of a number of suitable posts may be employed and these may be utilized interchangeably as suits the conditions of the environment. For example posts may be employed to display vertical panels, lights or object markers. This delineator post system is quite adaptable to change as suits the needs of the users.

Referring now to FIG. 7, in order to provide more resistance to the impacting force and also to provide more stiffness to the delineator post assembly, two compression springs may be employed as component parts of the load cell mechanism. Like parts are referred to by like reference numerals. A load cell arrangement is illustrated generally at 84 which is quite similar to that disclosed at 22 in FIG. 3 with the exception that longer cables and a dual spring arrangement is employed. The load cell components include upper and lower load cell elements 24 and 26 which may be of identical configuration. The load cell elements form vertical passages 50 and 52 through which extend elongated side-by-side cable members 86 and 88. The cables are of the same character as set forth at 54 and 56 of FIGS. 3 and 5 with the exception that the cables are of additional length to compensate for the length of a lower compression spring member 90. Spring member 90 is preferably identical to spring 48 but it may have a different spring force if desired. Platform washers 58 are located at the end of each compression spring adjacent respective ends of the cables and are secured by cable stop sleeve members 60 and 62. The platform washers form end stops for the respective compression springs 48 and 90. The compression springs function in concert to apply spring force through the cable stop sleeves to the cables 86 and 88 thereby placing the cables under additional tensile stress as compared to the single spring arrangements of FIGS. 3 and 5. The lower tubular element 92 may be a support base tube which is driven or otherwise fastened into the ground in the manner shown in FIG. 3. Alternatively, the tubular element 92 may take the form of a section of delineator post which is secured to an appropriate base structure or which is received within a support receptacle.

Although the cable members 86 and 88 have greater tensile stress as compared to cables 54 and 56 of FIG. 5, nevertheless the joint between the upper and lower load cell elements will readily yield when the delineator post 16 is impacted. Because of the dual cable arrangement the load cell is capable of yielding readily to the 90° position as shown in FIG. 2 or to a position in excess of 90° to permit the automotive vehicle to pass over the delineator post assembly while the undercarriage is clear of the load cell. Bending or pivoting of the post assembly will take place only along the x-axis of the delineator post and may occur omnidirectionally by impact from any direction. Regardless of the direction from which the delineator post is struck it will yield in the manner shown in FIG. 2. The dual springs will become additionally compressed during bending of the load cell. This additional spring force will urge the load cell to the position shown in FIG. 7 thereby uprighting the delineator post. The post will always return to its preset position thereby maintaining proper orientation of reflectors, vertical panels, lights, or object markers that might be secured to the post structure. As in the arrangements of FIGS. 3 and 5 the delineator post 16 is preferably of light weight construction and composed of a material that resists damage when impacted. The components are light weight so that the post remains rigid in windy conditions and does not tend to flutter under the influence of wind. The load cell 84 is quickly installed in assembly with the lower tubular element 92 and the delineator post 16 is easily and quickly installed in assembly with the load cell. Thus, the load cell and delineator post arrangement are quick and simple to install, replace and service. Although simple tubular delineator posts are shown which may be of cylindrical configuration, it should be borne in mind that the post element can take any suitable form. The post element can be an attractive extruded or molded structure of any suitable configuration which is provided with reflectors or other appropriate markers.

The dual spring load cell arrangement of FIG. 7, like the single spring load cells of FIGS. 3 and 5, is simple and efficiently assembled as compared to other spring loaded designs. The load cell elements are simply placed in assembly with the cable members extended through the respective passages. A platform washer and cable stop sleeve are then assembled to one end of the cables and the cable stop sleeve swaged onto the cables. A platform washer and cable stop sleeve are then assembled to the free end of the load cell assembly. When the springs are properly compressed to achieve a designed spring load, the second cable stop sleeve is swaged onto the cables at a proper measured distance along its length. The opposite spring stop is then seated, after which the cable can be cut adjacent to the spring stop. Assembly of the load cell may be efficiently accomplished in only a few minutes time. Disassembly and repair of a load cell may be accomplished similarly in only a few minutes time. The load cell is a separate part from the post or the base and therefore each of these components may be simply and efficiently replaced without requiring the complete delineator post construction to be discarded. The self-uprighting delineator post construction of this invention is therefore quite flexible in its manner of installation, use and replacement.

It is therefore clearly evident that the present invention is one well adapted to obtain all of the objects and advantages hereinabove set forth together with other objects and advantages that are inherent from a description of the apparatus itself.

It will be understood that certain combinations and subcombinations are of utility and may be employed without reference to other features and subcombinations. This is contemplated by and is within the scope of the present invention.

As many possible embodiments may be made of this invention without departing from the spirit and scope thereof it is to be understood that all matters hereinabove set forth or shown in the accompanying drawings are to be interpreted as illustrative and not in any limiting sense.

What is claimed is:

1. A self-uprighting delineator post construction comprising:

(a) base means adapted to be fixed to any suitable stationary object;

(b) a delineator post of light weight impact resistant composition;

(c) a pivotal load cell having supported connection with said base means and having supporting connection with said delineator post and comprising:

(1) upper and lower load cell elements disposed in abutting relation and forming an abutment joint, said load cell elements each forming a vertically aligned cable passage, said passage cross-section dimensioned in one direction slightly greater than a single cable diameter and in a perpendicular direction slightly greater than two cable diameters, said upper load cell element capable of pivoting at said abutment joint relative to said lower load cell element;

(2) a pair of wire rope cables disposed in close fitting side-by-side relation and extending through said vertically aligned passages of said upper and lower load cell elements said wire rope cables being capable of bending and resisting tensile elongation and cooperating with said geometric configuration of said aligned passages to prevent relative rotation of said load cell elements; and (3) at least one compression spring placing said wire rope cables under predetermined tensile load, said compression spring being further compressed upon pivoting of said upper load cell element relative to said lower cell element and developing an uprighting force urging said upper and lower load cell elements and said delineator post to the vertically aligned and properly oriented positions thereof.

2. A self-uprighting delineator post construction as recited in claim 1 wherein each of said upper and lower load cell elements forms tapered surface means, said tapered surface means cooperate in assembly to define a pivoting groove.

3. A self-uprighting delineator post construction as recited in claim 2 wherein said tapered surfaces of said upper and lower load cell elements are of frusto-conical configuration.

4. A self-uprighting delineator post construction as recited in claim 3, wherein:

(a) said vertically aligned passages of said upper and lower load cell elements define an x-axis of said load cell; and (b) said upper and lower load cell elements each form substantially planar abutment surfaces disposed in substantially normal relation with said x-axis, said substantially planar abutment surfaced being normally maintained in contact by the preload force of said compression spring.

5. A self-uprighting delineator post construction as recited in claim 1, wherein said pivoting groove has an angle of substantially 90°.

6. A self-uprighting delineator post construction as recited in claim 1 wherein said compression spring comprises:

(a) a compression coil spring being disposed about said pair of wire rope cables and having one end thereof in abutment with one of said upper and lower load cell elements;

(b) a spring stop being connected to said pair of wire rope cables and forming a support platform in retaining engagement with the opposite end of said compression coil spring; and (c) said compression coil spring being maintained under predetermined compression to thus apply a predetermined preload spring force against said of wire rope cables placing said wire rope cables under tensile stress, said compression coil spring being additionally compressed upon relative pivotal movement of said upper and lower load cell elements and developing an uprighting force urging said upper and lower load cell elements toward abutting relation thereof, said side-by-side wire rope cables returning said delineator post to predetermined rotational orientation upon pivotal movement to the upright position thereof.

7. A self-uprighting delineator post construction as recited in claim 1 wherein said at least one compression spring comprises:

(a) a pair of opposed compression coil springs being positioned with one of the ends thereof in abutment with respective ones of said upper and lower load cell elements;

(b) said pair of wire rope cables extending axially through each of said opposed compression coil springs; and (c) spring retainer means being secured to respective extremities of said pair of wire rope cables and engaging the opposite ends of said opposed compression coil springs and maintaining said opposed compression coil springs under predetermined compression thereby causing said opposed compression coil springs to apply the combined spring force thereof to said pair of wire rope cables to thus maintain said pair of wire rope cables under tensile stress.

8. A self-uprighting delineator post construction as recited in claim 1 wherein said base means comprises a sharp pointed ground penetrating element capable of being driven into the earth and forming a receptacle, said lower load cell element being received in interfitting supported engagement within said receptacle.

9. A self-uprighting delineator post construction as recited in claim 1 wherein said base means comprises:

(a) a base plate adapted to be fixed to a stationary objects;

(b) a retainer plate capable of being removably secured to said base plate, said retainer plate forming a retention flange cooperating with said base plate to form receptacle means; and (c) said lower load cell element forming a flange being retained within said receptacle means by said retention flange of said retainer plate means.

10. A self-uprighting delineator post construction as recited in claim 9, wherein said means securing said retainer plate in assembly with said base plate comprising a releasable connection, thus permitting removal of said retainer plate, said load cell and said delineator post from said base plate and permitting rotational adjustment of said lower load cell relative to said base plate.

11. A self-uprighting delineator post construction as recited in claim 1 wherein said delineator post comprises an elongated tubular delineator post member of light weight impact resistant construction being in releasable assembly with said upper load cell element, said delineator post member providing support for light reflectors, vertical panels, object markers and the like.

12. A self-uprighting delineator post construction as recited in claim 11, wherein said tubular delineator post is composed of an impact resistant polymer material.

13. A self-uprighting delineator post construction comprising:

(a) base means adapted to be fixed to any suitable stationary object;

(b) an elongated delineator post of light weight, impact resistant composition;

(c) a load cell having supported connection with said base means and having supporting connection with said delineator post and comprising:

(1) upper and lower load cell elements being disposed in abutment and forming an abutment joint having a circumferential pivoting groove, each of said upper and lower load cell elements forming a vertical cable passage, said passage cross-sectional dimensioned in one direction slightly exceeding the diameter of a cable and in a perpendicular direction slightly exceeding two cable diameters, said vertical passage of each of said load cell elements being disposed in vertical alignment, said upper and lower load cell elements being capable of pivotal movement in any direction in response to an impact force against said delineator post;

(2) a pair of wound wire cables extending through said vertically aligned passages of said upper and lower load cell elements, said pair of wound wire cables being disposed in side-by-side relation and closely fitting within said passage means and being in relatively movable relation with said upper and lower load cell elements, said wound wire cables being capable of bending and resisting tensile elongation and cooperating with said load cell elements at said aligned cable passages to prevent relative rotation of said load cell elements while upright and returning said delineator post to a preset rotational position upon pivotal movement thereof to its upright position; and (3) at least one compression spring being in engagement with at least one of said upper and lower load cell elements and being maintained under precompression for continuous application of tensile stress to said pair of wound wire cables, said tensile stress maintaining said upper and lower load cell elements in abutment and providing self-uprighting force to return said load cell elements to aligned abutting relation following release of impact force from said delineator post.

14. A self-uprighting delineator post construction as recited in claim 13, wherein said upper and lower load cell elements cooperate to define a circular circumferential pivoting groove at the abutment joint therebetween, said upper and lower load cell elements having relative pivotal movement at said abutment joint.

15. A self-uprighting delineator post construction as recited in claim 14, wherein said upper and lower load cell elements each form frusto-conical tapered surfaces, said frustoconical tapered surfaces interfit at said abutment joint to define said circular circumferential pivoting groove.

16. A self-uprighting delineator post construction as recited in claim 15, wherein:

(a) said passage means of said upper and lower load cell elements defines a vertical x-axis; and (b) said frusto-conical surfaces of said upper and lower load cell elements have an angle of about 45° relative to said x-axis, thereby causing said circumferential bending groove to have an angle of about 90°, said frusto-conical surfaces coming into line contact upon pivoting of said delineator post and load cell approximately 90° from the vertical in response to an impact force.

17. A self-uprighting delineator post construction as recited in claim 18, wherein:

(a) said circumferential pivoting groove formed by said frusto-conical tapered surfaces causes said delineator post to be capable of being pivoted from its upright position toward a horizontal position upon being impacted from any direction; and (b) said pair of cables are disposed in parallel relation with one another and thus prevent relative rotation of said upper and lower load cell elements and insure accurate return of said delineator post to its preestablished position during uprighting following an impact force against said delineator post.

* * * * *

UNITED STATES PATENT AND TRADEMARK OFFICE

CERTIFICATE OF CORRECTION

PATENT NO. : 4,806,046

DATED : February 21, 1989

INVENTOR(S) : RICHARD O. CLARK

It is certified that error appears in the above-identified patent and that said Letters Patent is hereby corrected as shown below:

IN THE ABSTRACT:

Line 12, delete "open" and insert --one--.

IN THE SPECIFICATION:

Column 3, Line 28, delete "lesat" and insert --least--.

Signed and Sealed this

Fifth Day of June, 1990

*Attest:*

*Attesting Officer*

HARRY F. MANBECK, JR.

*Commissioner of Patents and Trademarks*